US008979779B2

(12) United States Patent
Chen

(10) Patent No.: US 8,979,779 B2
(45) Date of Patent: Mar. 17, 2015

(54) LEFT AND RIGHT MOVABLE MASSAGE DEVICE

(75) Inventor: Jui Yao Chen, Changhua County (TW)

(73) Assignee: Listore International Co., Ltd., Changhua County (TW)

( * ) Notice: Subject to any disclaimer, the term of this patent is extended or adjusted under 35 U.S.C. 154(b) by 509 days.

(21) Appl. No.: 13/420,055

(22) Filed: Mar. 14, 2012

(65) Prior Publication Data

US 2013/0245515 A1 Sep. 19, 2013

(51) Int. Cl.

| | |
|---|---|
| ***A61H 7/00*** | (2006.01) |
| ***A61H 23/00*** | (2006.01) |
| *A61H 23/02* | (2006.01) |

(52) U.S. Cl.

CPC ..... *A61H 23/006* (2013.01); *A61H 23/0254* (2013.01); *A61H 2201/1215* (2013.01); *A61H 2201/1623* (2013.01)

USPC ..... 601/84; 601/97; 601/101; 601/112

(58) Field of Classification Search

CPC ..... A61H 2201/0149; A61H 2201/1207; A61H 2201/12; A61H 2205/081; A61H 2205/08; A61H 2015/0071; A61H 2015/0064; A61H 2015/0057; A61H 2015/005; A61H 2015/0042; A61H 2201/0138; A61H 1/003; A61H 1/001

USPC ..... 601/15, 18, 19, 20, 46, 49, 50, 51, 52, 601/53, 54, 56, 57, 58, 59, 63, 65, 67, 69, 601/70, 82, 84, 85, 86, 87, 89, 90, 91, 92, 601/93, 94, 95, 97, 98, 99, 100, 101, 102, 601/103, 107, 108, 110, 111, 112, 113, 115, 601/116, 118, 122, 126, 127, 129, 130, 131, 601/134

See application file for complete search history.

(56) References Cited

U.S. PATENT DOCUMENTS

| | | | | |
|---|---|---|---|---|
| 6,837,861 | B2 * | 1/2005 | Lin | 601/87 |
| 8,167,828 | B2 * | 5/2012 | Tsai | 601/98 |
| 8,202,235 | B2 * | 6/2012 | Huang | 601/103 |
| 2009/0093742 | A1 * | 4/2009 | Ferber et al. | 601/112 |

* cited by examiner

*Primary Examiner* — Valerie L Skorupa
*Assistant Examiner* — Tu Vo
(74) *Attorney, Agent, or Firm* — Alan D. Kamrath; Kamrath IP Lawfirm, P.A.

(57) ABSTRACT

A left and right movable massage device includes a first outer housing, a first inner housing, a motor, a left-and-right moving gear assembly, a second outer housing, a second inner housing and a massage assembly. The main driven gear is disposed on the first inner housing and is rotated by the motor, and the guiding pin is restricted in the direction restricting groove of the first inner housing, so that the rotation of the main driven gear is converted into linear motions in two directions to move the first inner housing in the left-and-right direction. With a single motor, different massage movements can be performed to meet different users' requirements.

10 Claims, 6 Drawing Sheets

LEFT AND RIGHT MOVABLE MASSAGE DEVICE

BACKGROUND OF THE INVENTION

1. Field of the Invention

The present invention relates to a massage device and, more particularly, to a left and right movable massage device.

2. Description of the Prior Art

Today, people are living under great pressure and therefore need to release stress by using some massage devices. Normally, a massage devices are provided with massage heads to carry out massage operation by ways of rotation, kneading or up and down movement. However, the conventional massage ways of rotating, kneading or movement might not be able to satisfy the demands of different users. Furthermore, the structure for moving the massage heads should normally be used in combination with guiding rails in such a manner that the massage heads are provided with guiding members, and a drive member drives the massage heads to rotate, to make the guiding members move along the guiding rails. It is clear that the rotation of the massage heads cause the displacement of the same. However, such arrangements would restrict the action of massage or displacement.

The present invention has arisen to mitigate and/or obviate the afore-described disadvantages.

SUMMARY OF THE INVENTION

The primary object of the present invention is to provide a left and right movable massage device capable of performing different massage movements.

To achieve the above object, a left and right movable massage device in accordance with the present invention comprises: a first outer housing, a first inner housing, a motor, a left-and-right moving gear assembly, a second outer housing, a second inner housing and a massage assembly.

The first outer housing includes a guiding portion extending in a left-and-right direction, and a direction perpendicular to the left-and-right direction is defined as a perpendicular direction. The first outer housing is further formed with a direction restricting groove extending in the perpendicular direction.

The first inner housing is formed at a bottom thereof with a guiding groove extending in the left-and-right direction, and the guiding portion is inserted in the guiding groove to make the first inner housing movable in the left-and-right direction.

The motor is fixed to the first inner housing and provided with at least one drive screw.

The left-and-right moving gear assembly includes a main driven gear pivotally disposed on the first inner housing in such a manner that the main driven gear is rotated by the motor. At a bottom of the main driven gear is eccentrically disposed a guiding pin which extends out of the first inner housing and into the direction restricting groove of the first outer housing.

The second inner housing is assembled to the first inner housing.

The second outer housing is assembled to the first outer housing and formed with a hole for accommodation of the second inner housing.

The massage assembly includes a massage head disposed on the second inner housing.

The main driven gear is disposed on the first inner housing and is rotated by the motor. The guiding pin is restricted in the direction restricting groove of the first inner housing, so that the rotation of the main driven gear is converted into linear motions in two directions to make the first inner housing movable in the left-and-right direction. With a single motor, different massage movements can be performed to meet different users' requirements.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
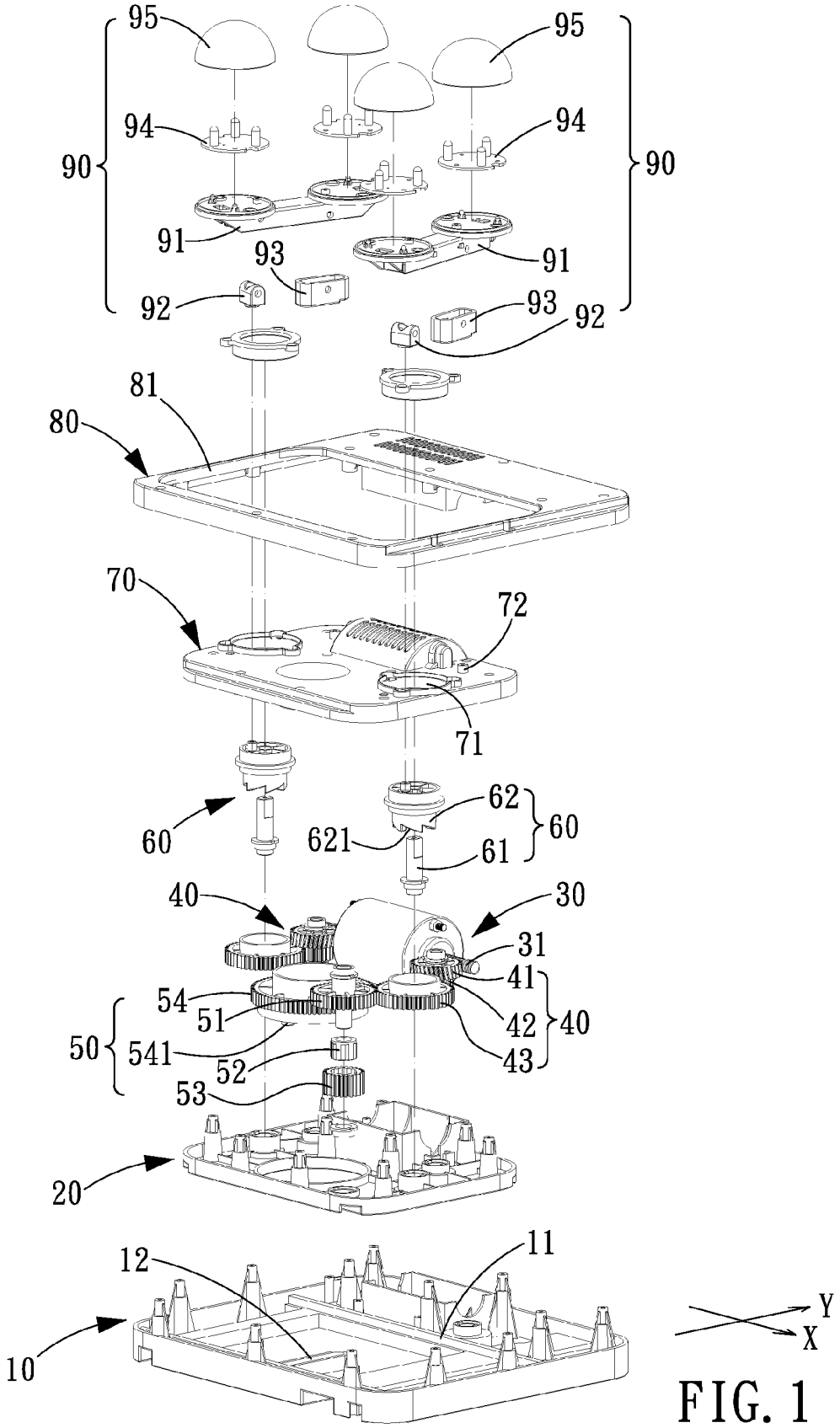
FIG. 1 is an exploded view of a left and right movable massage device in accordance with the present invention.
Figure 2:
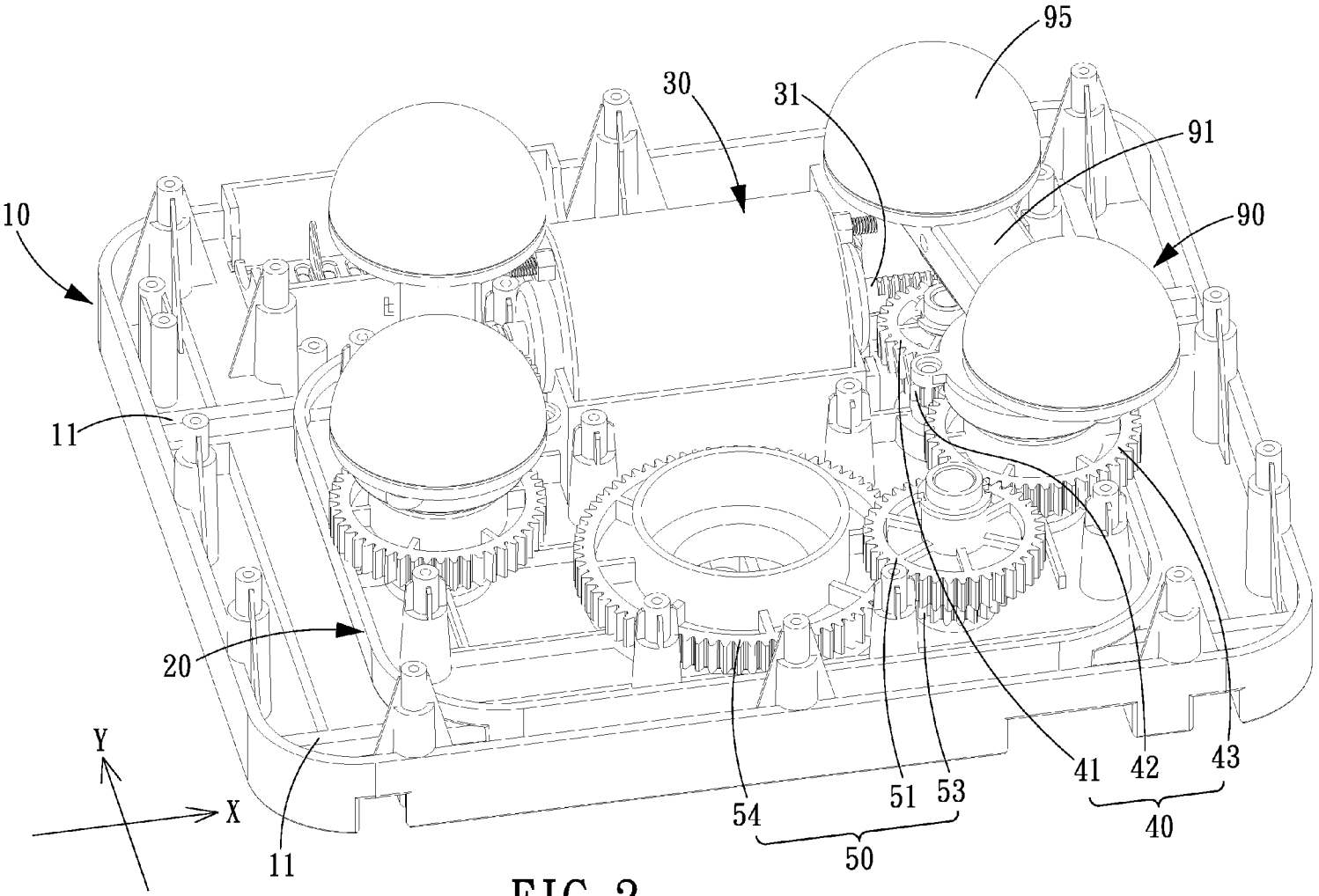
FIG. 2 is an assembly view of a part of the left and right movable massage device in accordance with the present invention.
Figure 3:
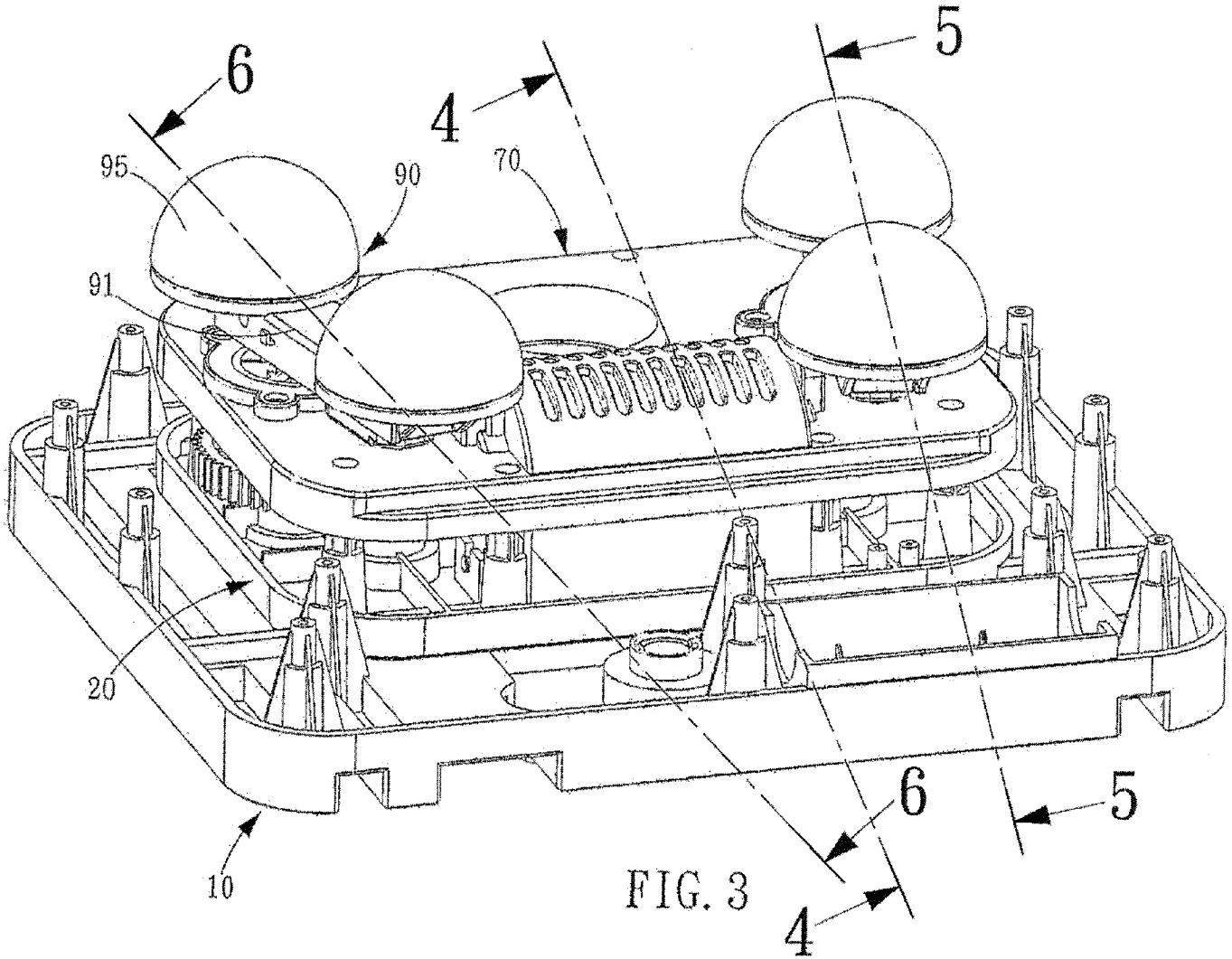
FIG. 3 is an assembly view of another part of the left and right movable massage device in accordance with the present invention.
Figure 4:
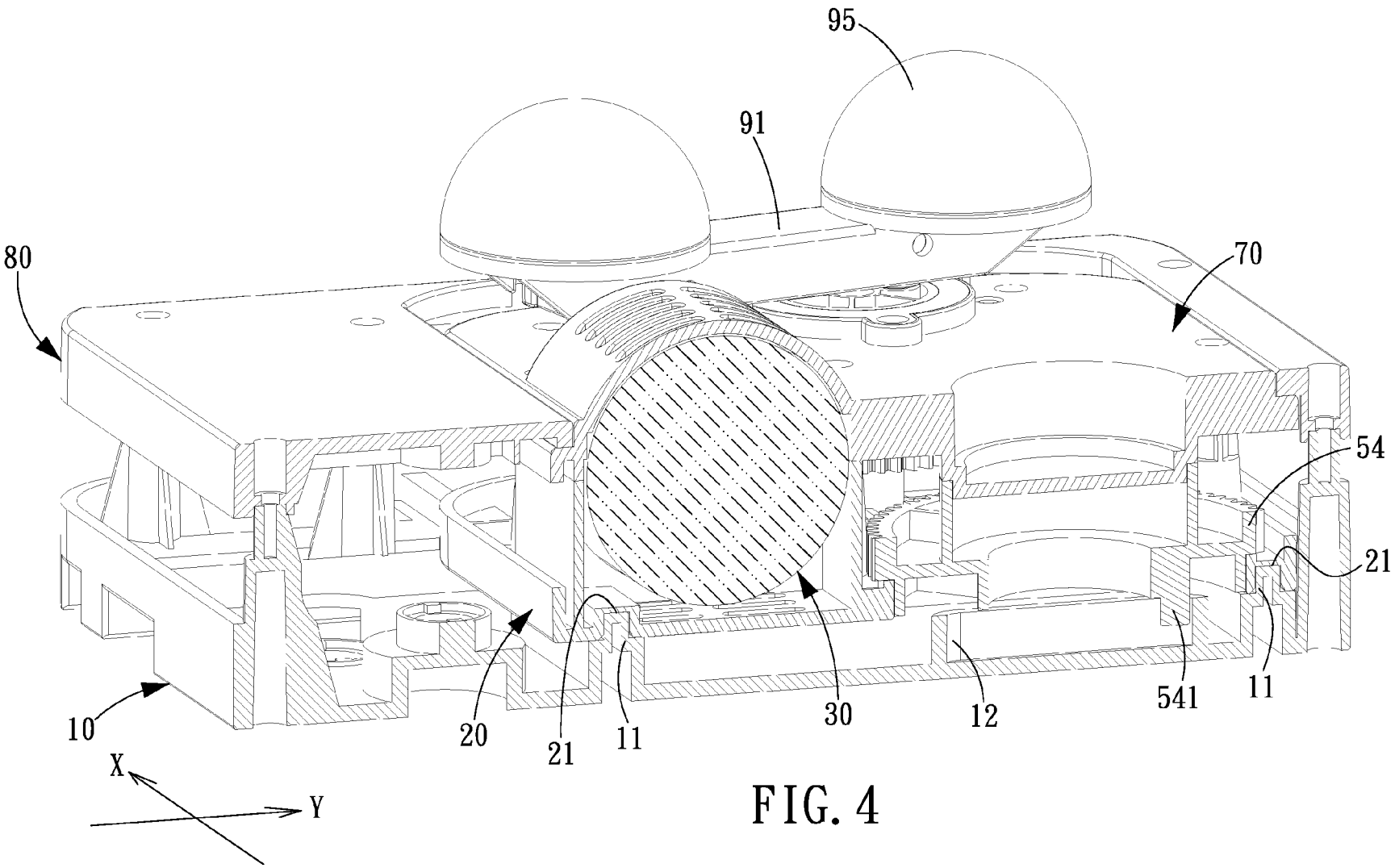
FIG. 4 is a cross sectional view of the left and right movable massage device according to section line 4-4 of FIG. 3 in accordance with the present invention.
Figure 5:
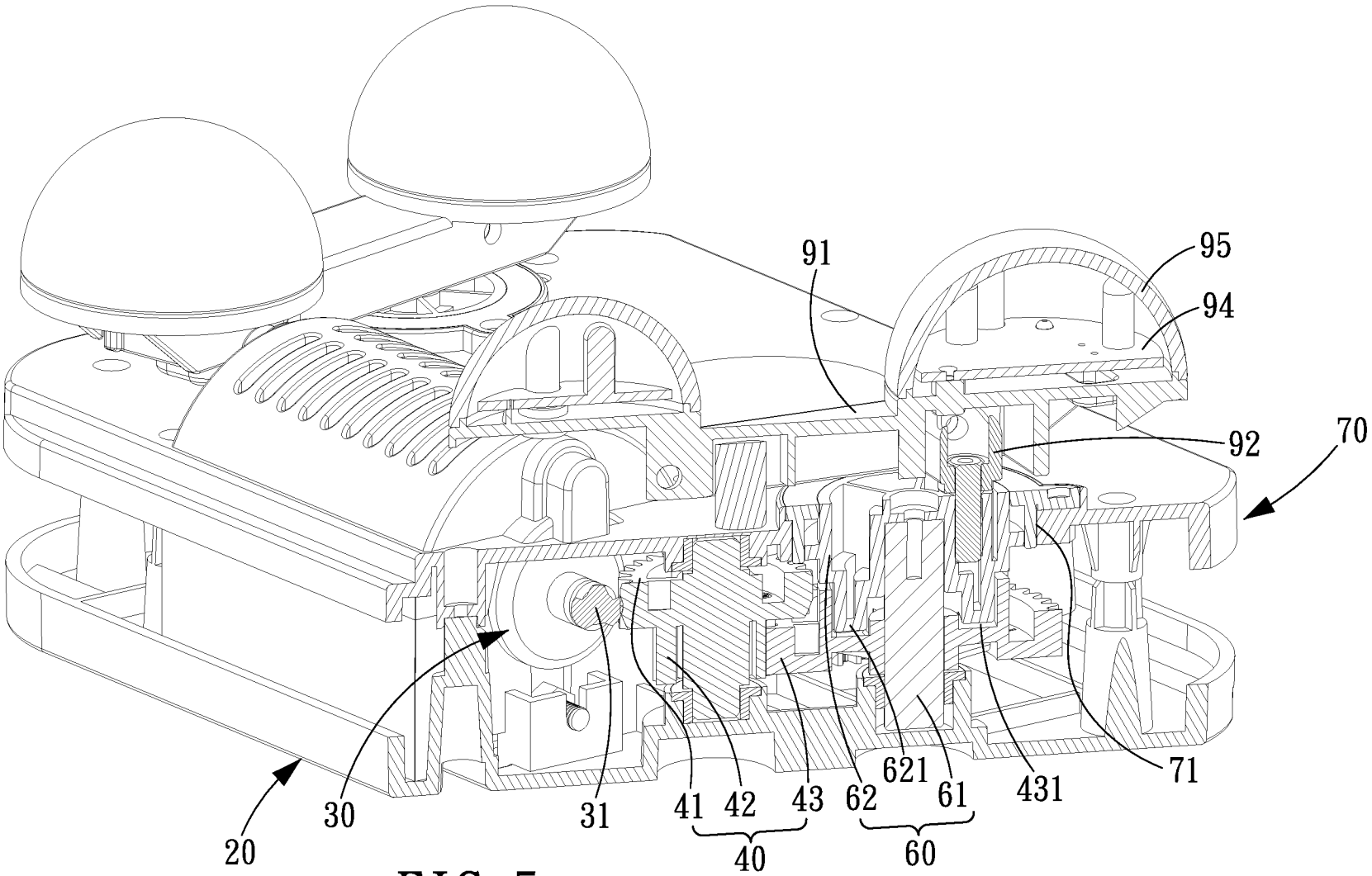
FIG. 5 is a cross sectional view of the left and right movable massage device according to section line 5-5 of FIG. 3 in accordance with the present invention, with portions removed for ease of illustration.
Figure 6:
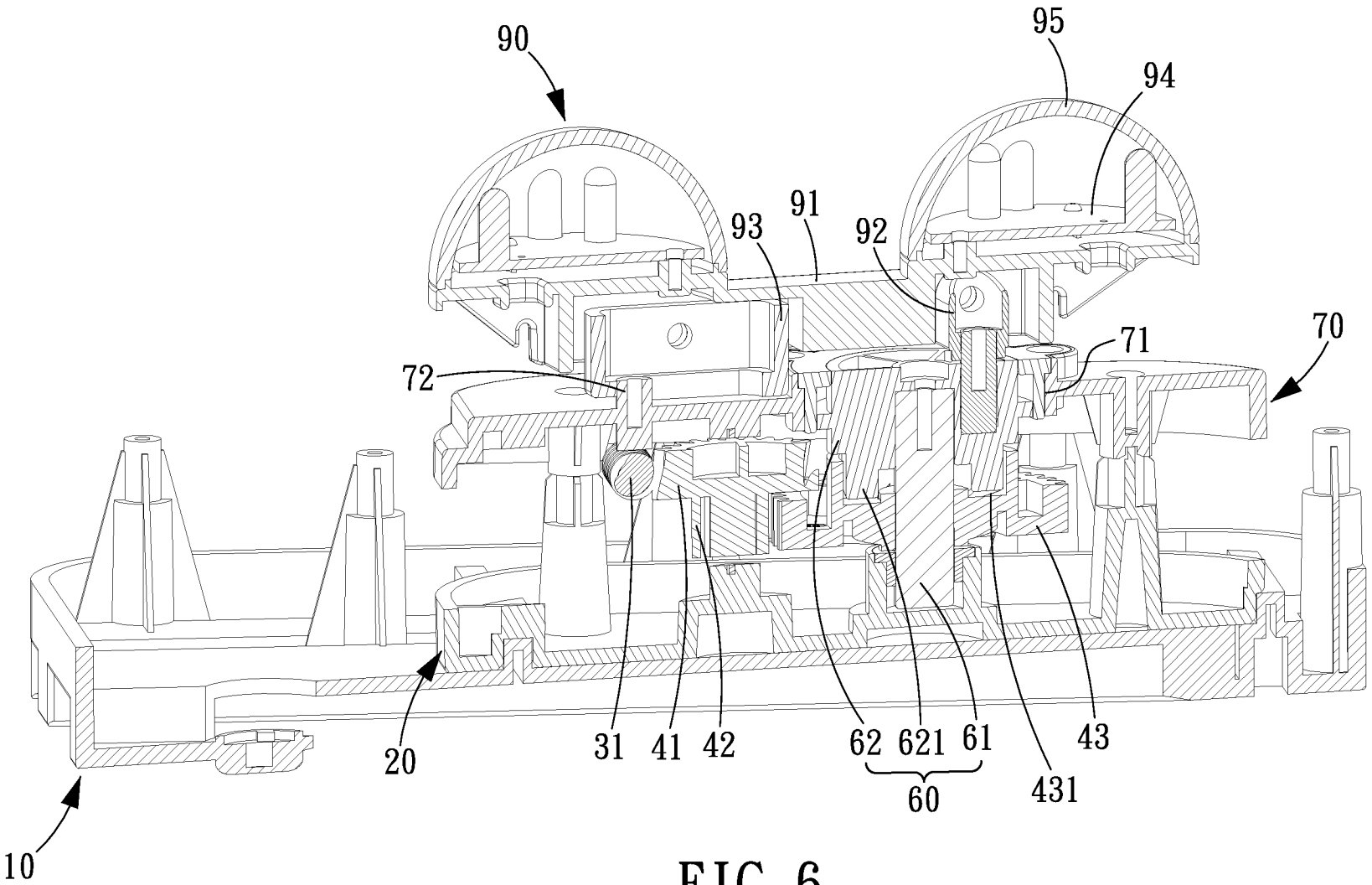
FIG. 6 is another cross sectional view of the left and right movable massage device according to section line 6-6 of FIG. 3, in accordance with the present invention.

Referring to FIGS. 1-6, a left and right movable massage device in accordance with the present invention comprises: a first outer housing 10, a first inner housing 20, a motor 30, two drive gear assemblies 40, a left-and-right moving gear assembly 50, two stroking assemblies 60, a second inner housing 70, a second outer housing 80, and two massage assemblies 90.

The first outer housing 10 includes two guiding portions 11. One of the guiding portions 11 extends in a left-and-right direction X, and the other guiding portion 11 extends in a perpendicular direction Y which is perpendicular to the left-and-right direction X. The first outer housing 10 is further formed with a direction restricting groove 12 extending in the perpendicular direction Y.

The first inner housing 20 is formed at the bottom thereof with two guiding grooves 21 extending in the left-and-right direction X, and the guiding portions 11 are inserted in the guiding grooves 21 to make the first inner housing 20 movable in the left-and-right direction X.

The motor 30 is fixed to the first inner housing 20 and is provided with two drive screws 31 disposed at two ends of the motor 30 and extending in the left-and-right direction X.

The drive gear assemblies 40 each include a first stage drive gear 41, a second stage drive gear 42 and a medium gear 43 which are pivotally disposed on the first inner housing 20 in such a manner that the first and second stage drive gears 41, 42 are concentrically superposed with each other. The first stage drive gear 41 is engaged with the drive screws 31 of the motor 30, and the second stage drive gear 42 is engaged with the medium gear 43. The first and second stage drive gears 41, 42 are different in number of teeth, and the medium gear 43 is provided with a plurality of beveled teeth 431.

The left-and-right moving gear assembly 50 is engaged with one of the two drive gear assemblies 40 and includes a first stage driven gear 51, a unidirectional bearing 52, a second stage driven gear 53 and a main driven gear 54 which are pivotally disposed on the first inner housing 20 in such a manner that the first stage driven gear 51 is engaged with the medium gear 43, the second stage driven gear 53 is sleeved on the unidirectional bearing 52 and superposed and concentric with the first stage driven gear 51, and the second stage driven gear 53 is engaged with the main driven gear 54. At the bottom of the main driven gear 54 is eccentrically disposed a guiding pin 541 which extends out of the first inner housing 20 and into the direction restricting groove 12 of the first outer housing 10.

Each of the stroking assemblies 60 includes a rotation stop shaft 61 and a push disc 62. The rotation stop shaft 61 and the medium gear 43 are concentrically disposed in the first inner housing 20. The push disc 62 is formed at the bottom thereof with a plurality of beveled toothed portions 621. The push disc 62 is sleeved on the rotation stop shaft 61, and the beveled toothed portions 621 of the push disc 62 are engaged with the beveled teeth 431 of the medium gear 43 to form a ratchet structure.

The second inner housing 70 is assembled to the first inner housing 20 and provided with two holes 71 allowing for passage of the push discs 62 of the stroking assemblies 60. On the second inner housing 70 are formed two protrusions 72.

The second outer housing 80 is assembled to the first outer housing 10 and formed with a hole 81 for accommodation of the second inner housing 70.

The two massage assemblies 90 each include an oscillating rod 91, a connecting block 92, a travel restricting block 93, two light emitting circuit boards 94 and two massage heads 95.

The connecting block 92 and the travel restricting block 93 are received in two ends of the oscillating rods 91, respectively. The connecting block 92 is eccentrically connected to the push disc 62, and the travel restricting block 93 is sleeved on the protrusions 72 of the second inner housing 70.

The light emitting circuit boards 94 are fixed at both ends of the oscillating rod 91.

The two massage heads 95 are disposed on and cover the light emitting circuit boards 94 and are exposed out of the hole 81 of the second outer housing 80.

When the motor 30 is powered on, the drive screws 31 at both ends of the motor 30 rotate the first stage drive gears 41 of the drive gear assemblies 40. Then, the first stage drive gears 41 rotate synchronously together with the second stage drive gears 42, the second stage drive gears 42 rotate the first stage driven gear 51, and the first stage driven gear 51 rotates together with the second stage driven gear 53 to drive the main driven gear 54 to rotate.

At this moment, the rotation of the main driven gear 54 will make the first inner housing 20 move in the left-and-right direction X and cause the guiding pin 541 of the main driven gear 54 to move linearly in the perpendicular direction Y due to the fact that the guiding pin 541 of the main driven gear 54 is received in the direction restricting groove 12 of the first outer housing 10. The main driven gear 54 is rotatably restricted in the first inner housing 20, and the first inner housing 20 is restricted by the guiding grooves 21 of the first outer housing 10 and consequently only movable in the left-and-right direction X. Therefore, when the main driven gear 54 keeps rotating, the first inner housing 20 will be caused to move in the left-and-right direction X.

When the motor 30 drives the left-and-right moving gear assembly 50 to move, the medium gears 43 also rotate. The beveled teeth 431 of the medium gears 43 will be engaged with the beveled toothed portions 621 of the push discs 62 in one direction to rotate the push discs 62, and when in opposite direction, the beveled teeth 431 of the medium gears 43 will be disengaged from and rotate idly with respect to the beveled toothed portions 621 of the push discs 62. For example, when the medium gears 43 rotate in a clockwise direction, the beveled teeth 431 of the medium gears 43 are disengaged from the beveled toothed portions 621 of the push discs 62, and the rotation of the medium gears 43 will cause the beveled teeth 431 to rotate with respect to the beveled toothed portions 621 of the push discs 62. When the medium gears 43 keep rotating, it will cause the cyclic motion of the beveled teeth 431 of the medium gears 43 to gradually engage with and disengage from the beveled toothed portions 621 of the push discs 62, resulting in repeated up and down movement of the push discs 62. Meanwhile, the massage assemblies 90 fixed to the push discs 62 also move up and down to perform a massage operation.

When rotating in a counterclockwise direction, the medium gears 43 can be engaged with the beveled toothed portions 621 to rotate the push discs 62. At this moment, one end of the oscillating rods 91 of the massage assemblies 90 fixed to the push discs 62 is caused to move together with the push discs 62, and another end of the oscillating rods 91 will be caused to oscillate since it is restricted by the two protrusions 72 of the second inner housing 70 and the travel restricting blocks 93. Consequently, the massage assemblies 90 are caused to oscillate to carry out an oscillating massage action.

On the other hand, the light emitting circuit boards 94 are disposed in the massage heads 95, so that light will be produced, accompanied by heat, during the massage operation, and the heat produced can provide a heating effect during the massage.

It is understood that when the motor 30 keeps rotating, the first inner housing 20 will drive all the components disposed on the first inner housing 20 to move in the left-and-right direction X, and the massage assemblies 90 can carry out the kneading or stroking massage in the form of up and down movement or continuous oscillation, to meet different user's demands.

The present invention is a simple structure, since it can carry out the different massage modes by only using a motor and a plurality of gears. Furthermore, the arrangement of the two-stage gears can reduce the size of the massage device.

While various embodiments in accordance with the present invention have been shown and described, it is clear to those skilled in the art that further embodiments be made without departing from the scope of the present invention.

What is claimed is:

1. A left and right movable massage device comprising:

a first outer housing including a guiding portion extending in a left-and-right direction, with the first outer housing formed with a direction restricting groove extending in a perpendicular direction perpendicular to the left and right direction;

a first inner housing formed at a bottom with a guiding groove extending in the left-and-right direction, with the guiding portion inserted in the guiding groove to move the first inner housing in the left-and-right direction;

a motor fixed to the first inner housing and provided with at least one drive screw;

a left-and-right moving gear assembly including a main driven gear pivotally disposed on the first inner housing, wherein the main driven gear is rotated by the motor, wherein a guiding pin is eccentrically disposed at a bottom of the main driven gear and extends out of the first inner housing and into the direction restricting groove of the first outer housing;

a second inner housing assembled to the first inner housing;

a second outer housing assembled to the first outer housing and formed with a hole for accommodation of the second inner housing; and a massage assembly including a massage head, with the massage head disposed on the second inner housing and exposed out of the hole of the second outer housing.

2. The left and right movable massage device as claimed in claim 1, wherein the motor is provided with a drive screw at both ends, and wherein each drive screw extends in the left-and-right direction.

3. The left and right movable massage device as claimed in claim 1 further comprising a drive gear assembly disposed between the at least one drive screw and the left-and-right moving gear assembly and including a medium gear pivotally disposed on the first inner housing, wherein the medium gear is rotated by the motor and engaged with the left-and-right moving gear assembly.

4. The left and right movable massage device as claimed in claim 3, wherein the drive gear assembly further includes a first stage drive gear and a second stage drive gear concentrically superposed with each other, wherein the first stage drive gear is engaged with the at least one drive screw of the motor, wherein the second stage drive gear is engaged with the medium gear, and wherein the first and second stage drive gears are different in number of teeth.

5. The left and right movable massage device as claimed in claim 3, wherein the left-and-right moving gear assembly further includes a first stage driven gear and a second stage driven gear, wherein the first stage driven gear is engaged with the medium gear, wherein the second stage driven gear is superposed and concentric with the first stage driven gear, and wherein the second stage driven gear is engaged with the main driven gear.

6. The left and right movable massage device as claimed in claim 5, wherein the second stage driven gear is sleeved on a unidirectional bearing.

7. The left and right movable massage device as claimed in claim 3 further comprises a stroking assembly including a rotation stop shaft and a push disc, wherein the rotation stop shaft and the medium gear are concentrically disposed in the first inner housing, wherein the medium gear is provided with a plurality of beveled teeth, wherein the push disc is formed at a bottom with a plurality of beveled toothed portions, wherein the push disc is rotatable on the rotation stop shaft, wherein the beveled toothed portions of the push disc are engaged with the plurality of beveled teeth of the medium gear, wherein the second inner housing is provided with two holes for passage of the push disc of the stroking assembly, and the massage assembly is connected to the push disc.

8. The left and right movable massage device as claimed in claim 7, wherein the massage assembly further includes another massage head disposed on the second outer housing, an oscillating rod and a connecting block which is disposed in one end of the oscillating rod, wherein the connecting block is eccentrically connected to the push disc, and wherein the massage heads are disposed at both ends of the oscillating rod.

9. The left and right movable massage device as claimed in claim 8, wherein the massage assembly further includes a travel restricting block, wherein two protrusions are formed on the second inner housing, and wherein the travel restricting block is received in another end of the oscillating rod and movable on the two protrusions.

10. The left and right movable massage device as claimed in claim 8, wherein a light emitting circuit board is provided between the massage head and the oscillating rod.

* * * * *